US005263295A

United States Patent [19]

Laird et al.

[11] Patent Number: 5,263,295

[45] Date of Patent: Nov. 23, 1993

[54] SUSPENDED SECURITY CEILING SYSTEM

[75] Inventors: Ralph H. Laird, New Berlin; Richard Kuchler, Big Bend; Lester G. Peterson, Milwaukee; William D. Benning, Hartland, all of Wis.

[73] Assignee: Wildeck, Inc., Waukesha, Wis.

[21] Appl. No.: 844,249

[22] Filed: Mar. 2, 1992

[51] Int. Cl.[5] ..... E04B 5/52

[52] U.S. Cl. ..... 52/489; 52/588

[58] Field of Search ..... 52/489, 488, 485, 484, 52/486, 630, 781, 241, 588, 814, 826, 276–279; 403/382, 230

[56] References Cited

U.S. PATENT DOCUMENTS

| | | | |
|---|---|---|---|
| 1,064,580 | 6/1913 | Wheeler | 52/262 |
| 2,023,814 | 12/1936 | Lindsey | 52/630 |
| 2,038,637 | 4/1936 | Brey | 52/826 |
| 2,099,211 | 11/1937 | Lucius | 52/588 |
| 2,804,953 | 9/1957 | Buehler | 52/814 |
| 4,464,074 | 8/1984 | Green et al. | 403/230 |

OTHER PUBLICATIONS

High Security Ceiling System, Design Sales Associates, Inc.

Noise-Lock Security Sound Absorption Systems for Correctional Facilities, Industrial Acoustics Company.

Spec-Data, Alcan Security Ceiling System, Alcan Building Products.

Celline Security Acoustical Ceiling System, Working Drawing and Specifications, Environmental Interiors Inc.

Ceiling Security Acoustical Ceiling System, Working Drawings For Optional Concealed fastening System, Environmental Interiors Inc.

*Primary Examiner*—James L. Ridgill, Jr.

*Attorney, Agent, or Firm*—Michael, Best & Friedrich

[57] ABSTRACT

The suspended security ceiling system includes a plurality of elongated ceiling panels having a planar web section and rail portions extending along the opposite side edges of the web section, a pair of channel-shaped wall mounts mounted on the opposed walls of a room, such as a prison or jail cell, and having an upper laterally extending flange and a lower laterally extending flange on which one end of a ceiling panel rests. The ceiling panels are held in place by channel-shaped retainer clips which are arranged to snap in between the upper and lower flanges of the wall supports at locations between the ceiling panel rails and have a lower leg which bears against the surface of the web sections of the ceiling panels to clamp them against the lower flanges of the wall supports. For larger rooms requiring ceiling panels end to end, generally inverted T-shaped intermediate supports suspended from ceiling joists or other overhead support and extending parallel to the wall supports are used. The intermediate supports resemble back to back wall supports and ceiling panels are held in place on the lower flanges of an intermediate support by retainer clips similar to those for the wall supports.

13 Claims, 2 Drawing Sheets

SUSPENDED SECURITY CEILING SYSTEM

BACKGROUND OF THE INVENTION

I. Field of the Invention

This invention relates to suspended ceiling systems including a plurality of ceiling panels supported on wall mounted supports and intermediate tee supports suspended from an overhead support and, more particularly, to suspended security ceiling systems for correctional institutions and other applications requiring tamper proof ceiling panels.

Suspended security ceiling systems typically include a plurality of rectangular metal ceiling panels including a planar web section, which is either solid or perforated, and side rails having a side wall extending upwardly from and along the length of the opposite edges of the web section. The opposite ends of the ceiling panels are supported on a flange of supports mounted on the opposite walls of a room. For larger rooms requiring ceiling panels end to end, one end or both ends of some ceiling panels are supported on the flanges of intermediate tee supports suspended from ceiling joist or similar overhead support. Primarily for security purposes, it is desirable for the ceiling support arrangement to be designed so that the ceiling panels cannot be removed, except for an access panel requiring special tools, and so that the ends of the ceiling panels cannot be pushed or pried away from supporting flanges of the wall-mounted supports or intermediate tee supports far enough to secret contraband, such as razor blades, drugs and the like.

II. Description of the Prior Art

In one type prior security ceiling system, the opposite ends of the ceiling panels are fastened to both upper and lower flanges on wall-mounted supports and tee supports by tamper proof metal screws. Installation of this type ceiling system is labor intensive and the heads of the screws for the lower flanges are visible and detract from the aesthetic appearance of the completed assembly.

In another type prior security ceiling system, the wall mounts include a first angle fixture anchored into the wall on which the security panels rest and a second angle anchored in the wall above the first angle and bearing against the top edges of the ceiling panel rails to restrain upward movement of the ceiling panels. The installation of this type security ceiling system also is labor intensive.

In another type of prior security ceiling system, the wall mounts and intermediate tee supports are extruded aluminum parts. The wall mounts are L-shaped and include a laterally extending support flange and guideways formed in the vertical part and the tee supports have a similar configuration. The ceiling panels are clamped against the support flanges of the wall mounts and tee support by extruded aluminum clamping members having a portion arranged to be received in the guideways. In addition to the cost associated with extruding the wall angles, tee supports and clamping members, the installation of type system also can be labor intensive.

In another type security ceiling system, the wall mounts and tee supports also are extruded from aluminum. The wall mounts and tee supports are similar to those described above, except that the guideways are located above the side rails of the ceiling panels and slidably receive generally L-shaped clips having a horizontal leg which bears against the top edges of the ceiling panel side rails and are secured thereto by metal screws or the like. This ceiling system is quite expensive to manufacture and install. Furthermore, the clips do not positively clamp the web section of the ceiling panels against the support flanges of the wall angle and the tee supports.

SUMMARY OF THE INVENTION

A primary object of this invention is to provide a suspended security ceiling system including a mounting arrangement which is simply constructed and convenient to install.

Another object of the invention is to provide such a security ceiling system in which the mounting arrangement positively clamps substantially the entire width of the web section of the ceiling panels against support flanges on the wall supports and also the tee supports if used.

Other objects, aspects and advantages of the invention will become apparent to those skilled in the art upon reviewing the following detailed description, the drawings and the appended claims.

The invention provides a suspended security ceiling system for an enclosure, such as a prison or jail cell, including a plurality of elongated ceiling panels having a planar web section and rail portions extending upwardly and longitudinally along each of the opposite side edges of the web section and a pair of generally channel-shaped wall supports adapted to be mounted on opposed walls of the enclosure. Each wall support has a vertical leg adapted to be mounted against a wall, an upper flange extending laterally inwardly from the upper portion of the vertical leg and a lower flange which extends laterally inwardly from a lower portion of the vertical leg and on which one end of the ceiling panels rests.

Generally inverted T-shaped intermediate supports are provided for enclosures requiring two or more ceiling panels end to end. The intermediate supports are supported from an overhead support and extend generally parallel to and spaced from an opposed pair of the wall supports and include a vertical leg, first and second upper flanges extending laterally outwardly in opposite directions from an upper portion of the vertical leg and first and second upper flanges extending laterally outwardly in opposite directions from the lower portion of the vertical leg. A first group of a plurality of the ceiling panels, disposed side by side with respect to each other and with the rail portions of adjacent ceiling panels abutting, rest on the lower flanges of an intermediate support and a plurality of ceiling panels, disposed side by side with respect to each other and with the rail portions of adjacent panels abutting and disposed end to end with respect to the first group, rest on the other lower flange of an intermediate support.

The ceiling panels are held in place by at least one generally channel-shaped retainer clip for each end of a panel including an upper leg extending laterally from the vertical leg and adapted to fit against the underside of the upper flanges of the wall supports and intermediate supports (when used) and a lower leg extending laterally from the vertical leg and adapted to fit against the surface of the web section of ceiling panels resting on lower flanges of the wall supports and intermediate supports (when used). The outside dimension of the upper and lower legs of the retainer clips approximate the inside dimension between the upper and lower flanges of the wall supports and intermediate supports, minus the thickness of the web section, whereby the retainer clips fit between the upper and lower flanges of the wall supports and intermediate supports (when used) with the upper leg bearing against an upper flange and the lower leg bearing against and clamping the web section against a lower flange to restrain the web section from being pushed or pried away from the lower flanges.

In a preferred embodiment, the retainer clip has a length less than, but corresponding to at least a major portion of, the distance between the rail portions of each ceiling panel so that one clip restrains substantially the entire width of the web section.

The upper flanges of the wall supports and the intermediate supports preferably are narrower than the respective lower flanges and the upper leg of the retainer clips is narrower than the lower leg so as to facility installation of the retainer clips.

DESCRIPTION OF THE PREFERRED EMBODIMENTS

Figure 1:
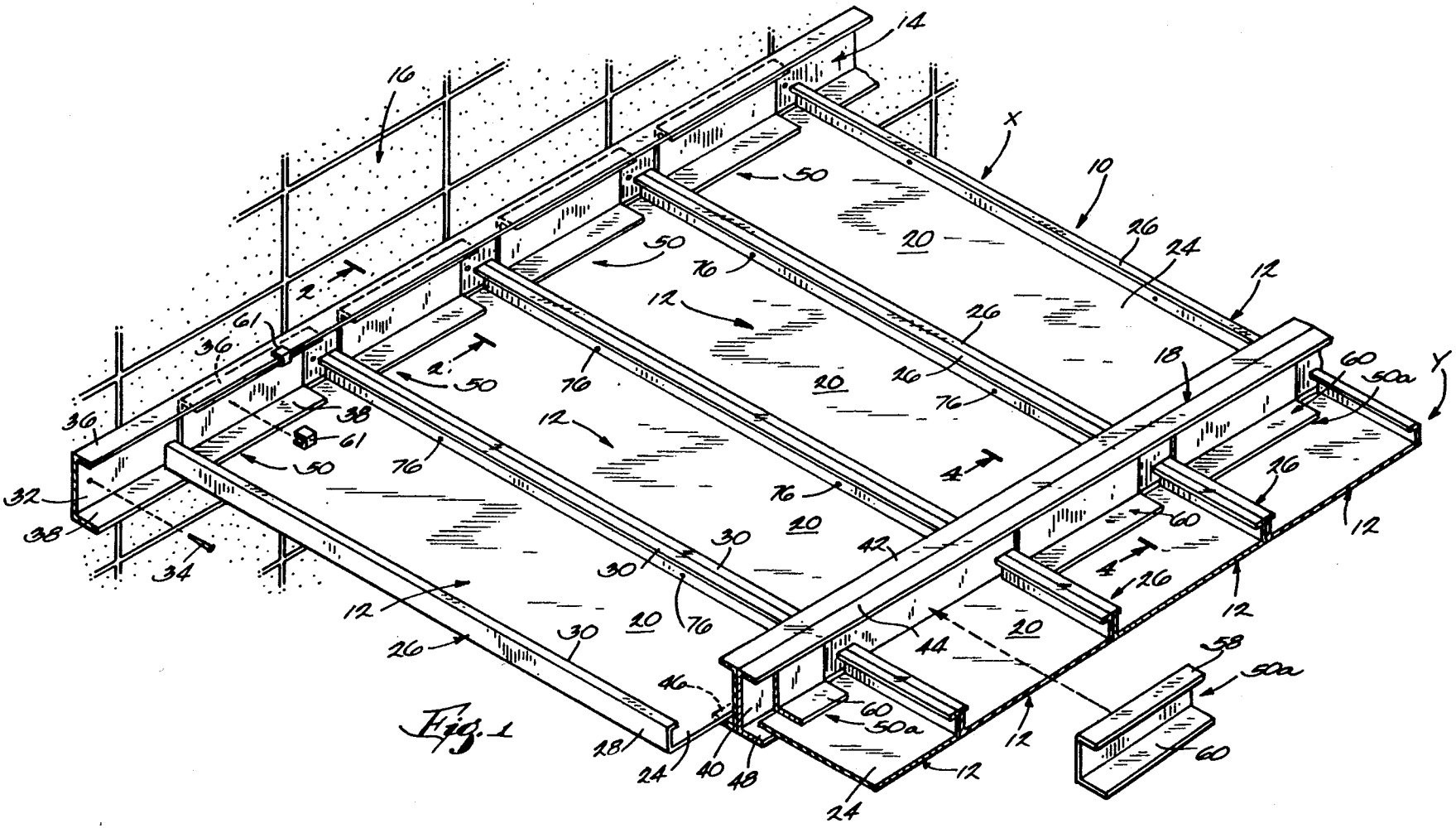
FIG. 1 is a fragmentary, perspective view (from above) of a suspended security ceiling system incorporating various features of the invention.

FIG. 1 illustrates a suspended security ceiling system 10 for use in an enclosure or room, such as a prison or jail cell. The ceiling system 10 includes a plurality of rectangular ceiling panels 12, channel-spaced wall supports 14 (one shown) mounted on opposed cell walls 16 (one shown) and, when the dimensions of a cell are such to require two or more ceiling panels end to end, a plurality of generally inverted T-shaped intermediate supports 18 extending parallel to an opposed pair of wall supports 16.

The ceiling panels 12, preferably brake formed, rolled or otherwise formed from a sheet metal such as steel, include an elongated planar web section 20, which can be solid or perforated, has an inner surface 22 facing the interior of the cell and an outer surface 24, and side rails 26 extending upwardly from and along the length of the opposite side edges of the web section 20. The ceiling panels 12 typically can be up to 15 feet and even longer when heavier sheet materials are used. Thus, for many applications a single ceiling panel 12 can span the width or length of a room and intermediate supports 18 are not required.

In the specific embodiment illustrated in FIGS. 1–5, each of the side rails 26 has a vertically extending side wall 28 and an inturned flange 30 extending laterally inwardly from the top portion of the side wall 28. If desired, the inturned flanges 30 can be omitted.

The wall supports 14, preferably brake formed, rolled or otherwise formed from a sheet metal such as steel, include a vertical wall or leg 32, which is mounted against a cell wall 16 by a plurality of bolts 34 anchored in the cell wall 16 or other suitable fastening means, an upper flange 36 extending laterally inwardly from the upper portion of the vertical leg 32 and a lower flange 38 extending laterally inwardly from the lower portion of the vertical leg 32. The wall mounts 14 typically are approximately 10 feet long and are located on the cell walls 16 so that the lower flanges 36 are at the desired height for the ceiling. The upper and lower flanges 34 and 36 are spaced apart a sufficient distance for one end portion of a plurality of ceiling panels 10, disposed side by side with the side rails 26 of adjacent ceiling panels 10 abutting, to fit therebetween with the web sections 20 resting on the lower flange 36 as illustrated in FIG. 1.

The intermediate supports 18, preferably brake formed, rolled or otherwise made from a sheet metal such as steel, include a vertical leg 40, a pair of upper flanges 42 and 44 extending laterally in opposite directions from the upper portion of the vertical leg 40 and a pair of lower flanges 46 and 48 extending laterally in opposite directions from the lower portion of the vertical leg 40. The intermediate supports 18 are suspended from ceiling joist or other similar supports (not shown) by hangers or the like (not shown) and extend parallel to an opposed pair of wall supports 14. The intermediate supports 18 are spaced from each other and from a wall support 14 so that the distance between the vertical legs 40 of adjacent intermediate supports 18 and the distance between the vertical legs 32 of the wall supports 14 and the vertical legs of the intermediate supports 18 approximates, but is slightly greater than, the length of the ceiling panels 12.

The upper and lower flanges 42 and 46 extending from one side of the vertical leg 40 of each intermediate support 18 are spaced apart a sufficient distance for one end portion of a first group X of the ceiling panels 12, disposed side by side with the side rails 26 of adjacent ceiling panels 12 abutting, to fit therebetween with the web sections 20 resting on the lower flange 46. The upper and lower flanges 44 and 48 extending in the opposite direction from the vertical leg 40 are spaced apart a sufficient distance for one end of a second group Y of ceiling panels 12, disposed side by side with respect to each other and end to end with respect to the first group X, to fit therebetween with the web sections resting on the lower flange 48 as illustrated in FIG. 1.

In the preferred construction illustrated, the intermediate supports 18 are similar to a pair of wall supports 14 and are fastened together back to back by welding or the like, thereby reducing fabrication costs.

Figure 2:
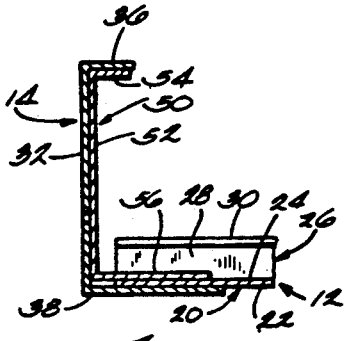
FIG. 2 is a sectional view taken generally along 2—2 in FIG. 1.

The ceiling panels 12 are held against the lower flanges 38 of the wall supports 14 by channel-shaped retainer clips 50 including a vertical leg 52 adapted to fit against or adjacent the vertical leg 32 of a wall support 14, a laterally inwardly extending upper leg 54 adapted to fit against the underside of the upper flange 36 of a wall support 14 and a lower leg 56 adapted to fit against the outer surface 24 of the web section 20 of a ceiling panel 12 as best illustrated in FIG. 2.

Figure 3:
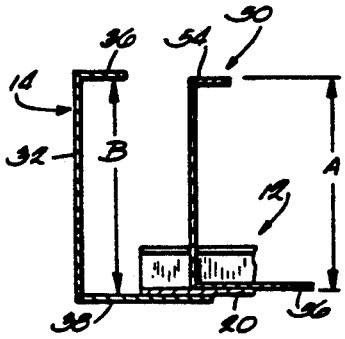
FIG. 3 is an exploded, sectional and partially fragmentary view of a wall mount with a ceiling in place prior to installation of a retainer clip.

Referring to FIG. 3, the outside dimension A of the upper and lower legs 54 and 56 of the retainer clips 50 approximates the inside dimension B between the upper and lower flanges 36 and 38 of a wall support 14, minus the thickness of the web section 20 of the ceiling panels 12, so that there is a tight enough fit between the lower leg 56 of the retainer clip 50 and the web section 50 to prevent the ceiling panels 12 from being pushed or pried away from the lower flange 38 of the wall mount 14. As a general guide, the wall supports 14 and the intermediate supports 18 can be formed from 12 gauge steel, the retainer clips 50 can be formed from 14 gauge steel and dimension A is 4 inches and dimension B is 3-15/16 inches when the ceiling panels 12 are formed from 16 gauge steel.

While two or more retainer clips 50 can be used for each end of a ceiling panel 12, they preferably have a length corresponding to at least a majority of the width of the web section 20 of the ceiling panels 12 so that only a single retainer clip 50 is required to restrain substantially the entire width of the web section 20 from being pushed or pried away from the lower flange 38 of the wall mounts 14. For example, when the inside width of the web section 20 is 12 inches or 18 inches, the retainer clips 50 can be 9½ inches and 15½ inches long, respectively.

Figure 4:
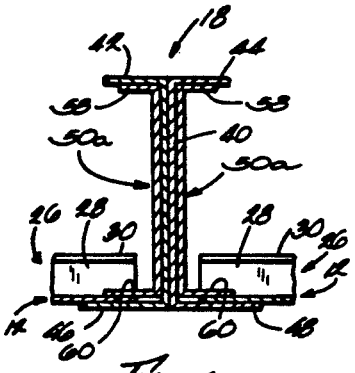
FIG. 4 is a sectional view taken generally along 4—4 in FIG. 1.

As best shown in FIG. 4, the ceiling panels 12 are held against the lower flanges 46 and 48 of the intermediate supports 18 by retainer clips **50*a* closely similar to or exactly like those described above. That is, they preferably are brake formed, rolled or otherwise formed from a sheet metal such as steel (e.g., 14 gauge steel), the inside dimension between the upper flanges 42 and 44 and the lower flanges 46 and 48 of the intermediate supports 18 is the same B for the wall supports 14 and the outside dimension of the upper and lower legs 58 and 60 of the retainer clips 50*a* is the same A for the wall support retainer clips 50**.

As best illustrated in FIGS. 2 and 3, the upper flange 56 of the wall supports 14 preferably is somewhat narrower than the lower flange 38 and the upper leg 54 of the retainer clips 50 preferably also is narrower than the lower leg 56. This facilitates installation of the retainer clips 50 after the ceiling panels 12 have been laid in place. As a general guide, the width of the upper and lower flanges 36 and 38 of the wall supports 14 can be 1 inch and 2½ inches, respectively, and the width of the upper and lower legs 54 and 56 of the retainer clips 50 can be ⅞ inch and 2¼ inches, respectively. For overall aesthetic appearance, the lower flanges 46 and 48 of the intermediate supports 18 preferably are somewhat narrower than the lower flange 38 of the wall supports 14 (e.g., 1½ inches vs. 2½ inches) so that the total width of the lower flanges 46 and 49 of the intermediate supports 18 is less than twice the width of a wall support flanges 38. Otherwise, the dimensional relationship of the flanges of the intermediate supports 18 and the retainer clips **50*a*** can be same as discussed above.

For many applications, adequate security can be provided by use of retainer clips 50 and **50*a* alone. For other applications requiring more security, additional means for restraining the ceiling panels 12** from being pushed or pried away from the lower flanges of the wall supports and the intermediate supports can be provided.

When sound absorption is desired, a conventional sound absorption material, in either loose or blanket form, can be laid over the outer surfaces 24 of the ceiling panels.

As illustrated in FIG. 1, one or more conventional barbed, U-shaped metal fasteners 61 can be tapped on over the edges of the adjoining upper flange 36 of the wall supports 14 and the upper leg 54 of the retainer clips 50 to further secure the retainer clips 50 in place. Similar fasteners can be used with the intermediate supports 18 and the retainer clips **50*a***.

Figure 5:
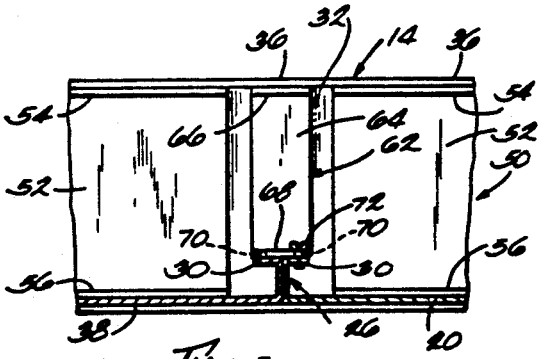
FIG. 5 is a fragmentary, partially section, elevation view of one end of a suspended ceiling system including an auxiliary clip at the joints between adjacent panels.

FIG. 5 illustrates a channel-shaped auxiliary retainer clip 62 which can be used at the joints between the rails 26 of adjacent ceiling panels 12, at one or both ends of the ceiling panels 12 to provide further security. Each auxiliary clip 62 includes a vertical leg 64 adapted to fit against or adjacent the vertical leg of a wall support or intermediate support, a laterally inwardly extending upper leg 66 adapted to fit against the underside of the upper flange of a wall support or intermediate support in the space between retainer clips 50, **50*a* and a laterally inwardly extending lower leg 68 adapted to fit against the top surface of the inturned flanges 30 of the rails 26 of adjacent ceiling panels 12. As illustrated in FIG. 5, the outside dimension of upper and lower legs 66 and 68 of the auxiliary retainer clip 62 approximates the inside dimension between the upper flanges of the wall supports 14 and intermediate supports 18 and the top surfaces of the rail flanges 30 so there is a tight enough fit between the lower leg 68 of the auxiliary retainer clip 62 and the flanges 30 to prevent the ceiling panels 12** from being pushed or pried away from the lower flanges of the wall supports and intermediate supports in the vicinity of the joints between adjacent ceiling panels.

In the specific construction illustrated in FIG. 5, the lower leg 68 of the auxiliary retainer clip 62 has a pair of apertures 70, each alignable with a rail flange 26, through which a metal screw 72 can be installed to secure the auxiliary retainer clip 62 in place. While only one metal screw 72 is necessary for this purpose, use of two apertures 70 gives an installer the option of choosing the most convenient location.

Figure 6:
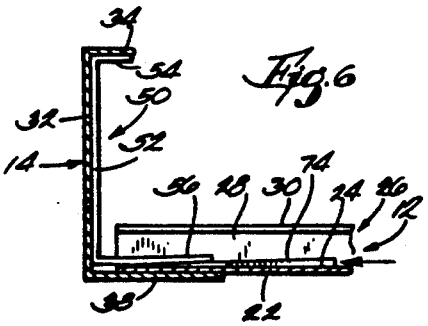
FIG. 6 is a fragmentary, partially sectional view of an alternate embodiment of the invention including a clip for restraining movement of abutting side rails of adjacent ceiling panels.

In the event some space exists between a ceiling panel web section 20 and the lower flange 38 of a wall support 14 or a lower flange 46, 48 of an intermediate support 18 after installation, e.g., because of a build up of manufacturing tolerances, thin metal shims 74 can be driven between the top surface 24 of the web section 20 and those lower flanges as illustrated in FIG. 6. As a further safety precaution, the side rails 26, of adjacent ceiling panels 12 can be fastened together with metal screws 76 or other suitable fasteners as illustrated in FIG. 1.

Figure 7:
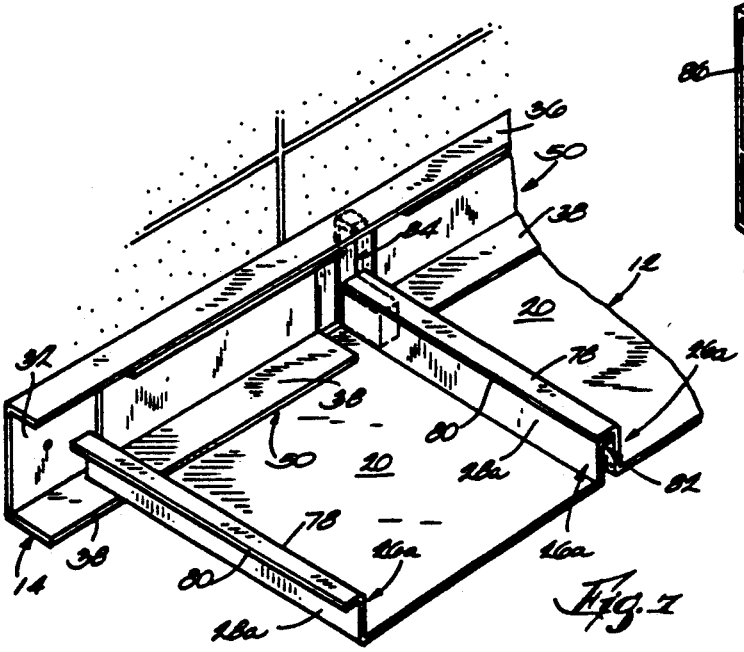
FIG. 7 is a fragmentary, perspective view (from above) similar to FIG. 1 illustrating an alternate arrangement of the ceiling panel side rails.

FIG. 7 illustrates an alternate embodiment for the ceiling panels 12. In this embodiment, the side rails **26*a* of the ceiling panels 12 include a side wall 28*a* similar to the embodiment illustrated in FIGS. 1-6. However, instead of having an inturned flange, each side rail 26*a* has an outturned flange 78 which extends laterally outwardly from the top portion of the side wall 28*a* and terminates in a longitudinally extending edge 80. When the ceiling panels 12 are installed side by side as illustrated in FIG. 7, the flanges 78 of adjacent ceiling panels 12 overlap and the edge 80 of one abuts the side wall 28*a* of the other to define a longitudinally extending, rectangular recess 82 between the ceiling panels 12**.

There can be an opening at the end of the recesses 82 between the ends of the ceiling panels 12 and the vertical legs of the wall supports and the intermediate supports. A spacer clip 84 is provided to close that opening.

Figure 8:
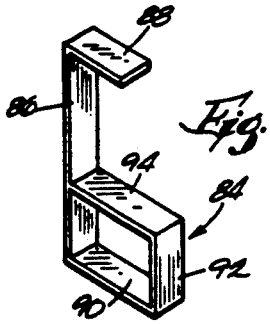
FIG. 8 is a perspective view of a spacer clip which fits into the end portion of the recess between adjacent ceiling panels in the arrangement illustrated in FIG. 6.

The spacer clip 84 (FIG. 8) has a rear leg 86 adapted to fit against or adjacent the vertical leg 32 of a wall support 14 or the vertical leg 40 of an intermediate support 18, an upper leg 88 extending horizontally outwardly from the rear leg 86 and adapted to fit against the underside of the upper flange 36 of a wall support 14 or the upper flanges 42 and 46 of an intermediate support 18, a lower leg 90 extending horizontally from the rear leg 86 and having a width approximating the width of the recess 82 between ceiling panels 12, a front leg 92 extending vertically upwardly from the lower leg 90 and having a width approximating the width of the recess 82 and a height approximately the depth of the recess 82, and an intermediate leg 94 extending between the front leg 92 and the rear leg 86 and having a width approximating the width of the recess 82.

The spacer clips 84 are snapped into place between the upper and lower flanges 36 and 38 of the wall mounts 14 and between the upper flanges 42 and 44 and lower flanges 46 and 48 of the intermediate supports 18 before the ceiling panels 12 are installed. The lower, front intermediate and rear legs 90, 92, 94 and 86 cooperate to define a box-like structure which completely fills the end portion of a recess 82.

The ceiling panels 12 can be fastened together by installing conventional tamper proof metal screws (not shown) through the flanges 78 from below. Also, the spacer clips 84 can be secured in place by installing a metal screw (not shown) through the upper flanges of a wall support and the intermediate supports into the top leg 88 of the spacer clips 84 and/or through the overlapping ceiling panel flanges 78 into the intermediate leg 94 of the spacer clips 84.

From the above description, it can be seen that the suspended security ceiling system provided by the invention includes a support arrangement for the ceiling panels which is simply constructed and convenient to install. Also, except for an access panel and the alternate embodiment illustrated in FIG. 7, all the retainer clips, mounting bolts, metal screws and other fasteners for securing the ceiling panels are completely concealed.

From the foregoing description, one skilled in the art can easily ascertain the essential characteristics of the invention and, without departing from the spirit and scope thereof, make various changes and modifications to adapt it to various usages.

We claim:

1. A suspended security ceiling system for an enclosure having opposed walls comprising a plurality of elongated ceiling panels including a planar web section having opposed inner and outer surfaces respectively facing toward and away from the interior of the enclosure, opposed side edges, opposed end portions and a rail portion extending upwardly from and longitudinally along each of said side edges;

a pair of generally channel-shaped wall supports adapted to be mounted on opposed walls of a room, each of said wall supports including a vertical leg adapted to be mounted against a wall, an upper flange extending laterally inwardly from an upper portion of said vertical leg and a lower flange extending laterally inwardly from a lower portion of said vertical leg, said upper and lower flanges being spaced apart a sufficient distance for one end portion of a plurality of said ceiling panels, disposed side by side with the rail portions of adjacent panels abutting, to fit therebetween and rest on said lower flange; and at least one generally channel-shaped retainer clip for each end of a said ceiling panel, each of said retainer clips having a vertical leg, an upper leg extending laterally from said vertical leg and adapted to fit against the underside of the upper flange of a said wall support and a lower leg extending laterally from said vertical leg and adapted to fit against the outer surface of the web section of a said ceiling panel resting on the lower flange of said wall support, the outside dimension of the upper and lower legs of said retainer clip approximating the inside dimension between upper and lower flanges of said wall support minus the thickness of the web section of said ceiling panel, whereby said retainer clip fits between the upper and lower flanges of a said wall support with the upper leg bearing against the upper flange of said wall support member and the lower leg bearing against and clamping the web section against the lower flange of said wall support to retain said web section from being pushed or pried away such lower flange.

2. A ceiling support system according to claim 1 wherein said retainer clip has a length less than, but corresponding to at least a major portion of, the distance between the rail portions on each ceiling panel so that one of said retainer clips restrains substantially the entire width of said web section.

3. A ceiling system according to claim 1 wherein the upper flange of said wall support and the upper said retainer clip have a width substantially less than the width of the respective lower flange of said wall support and lower leg of said retainer clip so as to facilitate installation of said retainer clip.

4. A ceiling system according to claim 1 wherein each of said rail portions include a side wall extending upwardly from and longitudinally along the respective side edge portion of said web section; and an inturned flange extending laterally inwardly from said side wall portion, whereby, when a plurality of said ceiling panels are installed side by side, the side wall portions of adjacent ceiling panels abut.

5. A ceiling system according to claim 4 including channel-shaped auxiliary retainer clips for installation at the joints between adjacent ceiling panels, each of said auxiliary clips comprising a vertical leg;

an upper leg extending laterally from said vertical leg and adapted to fit against the underside of the upper flange of a said wall support or an intermediate support member;

a lower leg extending laterally from said vertical leg and adapted to fit against the top surface of the inturned flanges of adjacent ceiling panels at the joint therebetween.

6. A ceiling system according to claim 1 wherein each of said rail portions includes a side wall extending upwardly from and longitudinally along the respective side edge portion of said web section; and an outturned flange extending laterally outwardly from said side wall portion and terminating in an outer edge, whereby, when a plurality of said ceiling panels are installed side by side, the outer flanges of adjacent ceiling panels overlap and the outer edge of one abuts the side wall of the other to form an elongated recess between adjacent ceiling panels.

7. A ceiling system accordinq to claim 6 including a spacer clip comprising a vertical rear leg;

an upper leg extending horizontally from said rear leg and adapted to fit against the underside of the upper flange of a said wall support or said an intermediate support member;

a lower leg extending horizontally from said rear leg and having a width approximating the width of said recess;

a front leg spaced from said rear leg and extending vertically from said lower leg, said front leg having a width approximating the width of said recess and a height approximating the depth of said recess; and an intermediate leg extending horizontally between said front and rear legs and cooperating with said rear, lower and front legs to fill an end portion of said recess adjacent said wall support or said intermediate support member.

8. A ceiling system according to claim 1 further comprising at least one generally inverted T-shaped intermediate support member adapted to be supported from an overhead support and extending generally parallel to and spaced from an opposed pair of said wall support, said intermediate support member including a vertical leg, first and second upper flanges extending laterally outwardly in opposite directions from an upper portion of said vertical leg and first and second lower flanges extending laterally outwardly in opposite directions from a lower portion of said vertical leg;

the first upper and lower flanges of said intermediate support member being spaced apart a sufficient distance for one end portion of a first group of a plurality of said ceiling panels, disposed side by side with the rail portions of adjacent ceiling panels abutting, to fit between said first upper and lower flanges and rest on said first lower flange;

the second upper and lower flanges of said intermediate support member being spaced apart a sufficient distance for one end of a second group of a plurality of said ceiling panels, disposed side by side with respect to each other and with the rail portions of adjacent panels abutting and disposed end to end with respect to the first group, to fit between said second upper and lower flanges and rest on said second lower flange; and a said retainer clip for each of said ceiling panels adapted to fit between the first and second upper and lower flanges of said intermediate support member in the manner recited in claim 1.

9. A ceiling system according to claim 8 wherein said retainer clip has a length less than, but corresponding to at least a major portion of, the distance between the rail portions for each ceiling panel so only one of said clips restrains substantially the entire width of said web section.

10. A ceiling system according to claim 8 wherein the first and second upper flanges of said intermediate support member and the upper leg of each of said retainer clip has a width substantially less than the width of the respective first and second lower flanges of said intermediate support member and said leg of each said retainer clip so as to facilitate installation of said retainer clips.

11. A suspended security ceiling system for an enclosure having opposed walls comprising a plurality of elongated ceiling panels including planar web section having opposed inner and outer surfaces respectively facing toward and away from the interior of the enclosure, opposed side edges, opposed end portions and a rail portion extending upwardly from and longitudinally along each of said side edges;

a pair of generally channel-shaped wall supports adapted to be mounted on opposed walls of a room, each of said wall supports including a vertical leg adapted to be mounted against a wall, an upper flange extending laterally inwardly from an upper portion of said vertical leg and a lower flange extending laterally inwardly from a lower portion of said vertical leg, said upper and lower flanges being spaced apart a sufficient distance for one end portion of a plurality of said ceiling panels, disposed side by side with the rail portions of adjacent panels abutting, to fit therebetween and rest on said lower flange; and at least one generally channel-shaped retainer clip for each end of a said ceiling panel, each of said retainer clips having a vertical leg, an upper leg extending laterally from said vertical leg and adapted to fit against the underside of an upper flange of a said wall support and a lower leg extending laterally from said vertical leg and adapted to fit against the outer surface of the web section of a said ceiling panel resting on a lower flange of a said wall support, the outside dimension of the upper and lower legs of said retainer clip approximating the inside dimension between upper and lower flanges of said wall and intermediate supports, minus the thickness of the web section of said ceiling panel, and the upper flange of said wall supports and the upper legs of said retainer clip having a width substantially less than the width of the respective lower flanges of said wall support and lower leg of said retainer clip whereby a said retainer clip fits between the upper and lower flanges of said wall supports with the upper leg bearing against the upper flange thereof and the lower leg bearing against and clamping the web section against the lower flange thereof to retain said web section from being pushed or pried away such lower flange.

12. A ceiling system according to claim 11 wherein said retainer clip has a length less than, but corresponding to at least a major portion of, the distance between the rail portions of said ceiling panels so that one of said retainer clips restrains substantially the entire width of said web section.

13. A ceiling system according to claim 12 further comprising at least one generally inverted T-shaped intermediate support member adapted to be supported from an overhead support and extending generally parallel to and spaced from an opposed pair of said wall support, said intermediate support member including a vertical leg, first and second upper flanges extending laterally outwardly in opposite directions from an upper portion of said vertical leg and first and second lower flanges extending laterally outwardly in opposite directions from a lower portion of said vertical leg, the first upper and lower flanges of said intermediate support member being spaced apart a sufficient distance for one end portion of a first group of a plurality of said ceiling panels, disposed side by side with the rail portions of adjacent ceiling panels abutting, to fit between said first upper and lower flanges and rest on said first lower flange, and the second upper and lower flanges of said intermediate member being spaced apart a sufficient distance for one end of a second group of a plurality of said ceiling panels, disposed side by side with respect to each other and with the rail portions of adjacent panels abutting and disposed end to end with respect to the first group, to fit between said second upper and lower flanges and rest on said second lower flange; and a said retainer clip for each of said ceiling panel adapted to fit between the first and second upper and lower flanges of said intermediate support member in the manner recited in claim 1.

* * * * *

UNITED STATES PATENT AND TRADEMARK OFFICE

CERTIFICATE OF CORRECTION

PATENT NO. : 5,263,295

DATED : November 23, 1993

INVENTOR(S) : Raplp H. Laird et al.

It is certified that error appears in the above-indentified patent and that said Letters Patent is hereby corrected as shown below:

Column 8, line 32, after "upper" (second occurrence), insert --leg of --.

Signed and Sealed this

Tenth Day of May, 1994

Bruce Lehman

*Attest:*

BRUCE LEHMAN

*Attesting Officer*

*Commissioner of Patents and Trademarks*